US007100492B2

(12) United States Patent
Fish

(10) Patent No.: US 7,100,492 B2
(45) Date of Patent: Sep. 5, 2006

(54) END CAP ASSEMBLY

(75) Inventor: Elson B. Fish, Lakeville, IN (US)

(73) Assignee: Polygon Company, Walkerton, IN (US)

( * ) Notice: Subject to any disclaimer, the term of this patent is extended or adjusted under 35 U.S.C. 154(b) by 0 days.

(21) Appl. No.: 10/962,078

(22) Filed: Oct. 6, 2004

(65) Prior Publication Data

US 2006/0070520 A1 Apr. 6, 2006

(51) Int. Cl.
*F01B 29/00* (2006.01)

(52) U.S. Cl. ..... 92/128; 92/165 R

(58) Field of Classification Search ..... 92/128, 92/165 R, 169.1

See application file for complete search history.

(56) References Cited

U.S. PATENT DOCUMENTS 4,739,694 A 4/1988 Flüeli et al.
4,862,786 A * 9/1989 Boyer et al. ..... 91/26
5,465,647 A * 11/1995 Fish ..... 92/128
5,651,303 A 7/1997 Fish
5,669,284 A 9/1997 Fish
6,171,486 B1 1/2001 Green et al.
6,186,043 B1 2/2001 Callies
6,269,734 B1 8/2001 Leidecker et al.
6,481,335 B1 11/2002 Shteynberg

* cited by examiner

*Primary Examiner*—Thomas E. Lazo
(74) *Attorney, Agent, or Firm*—Barnes & Thornburg LLP; Mark J. Nahnsen; Vladimir Khodosh

(57) ABSTRACT

A fluid activated cylinder assembly including an end cap having an annular protrusion and a hollow cylinder having an end zone. The cylinder applies compressive force to the annular protrusion in the end zone. The end zone having no accommodating cavity and no accommodating protrusion for the annular protrusion.

9 Claims, 4 Drawing Sheets

END CAP ASSEMBLY

BACKGROUND OF THE INVENTION

1. Field of the Invention

The present invention relates to a cylinder assembly, and, more particularly, to an end cap assembly of a cylinder assembly.

2. Description of the Related Art

Various techniques are employed to attach an end cap of a power cylinder to a cylindrical piston casing. Power cylinders that are metallic often use conventional threading, swaging or a welding technique to attach the end cap to the cylinder. In many instances, however, it is desirable to construct fluid power cylinders out of plastic materials in applications where strength-to-weight ratios are important considerations and in corrosive environments. Conventional techniques employed in the assembly of metallic cylinders do not apply to plastics. Additionally, it is desirable to construct fluid power cylinders that are disposable rather than repairable, since unskilled personnel may improperly replace fluid seals with disastrous consequences when the cylinder is put back into service.

What is needed in the art is an economic method of constructing a cylinder assembly.

SUMMARY OF THE INVENTION

The present invention provides an end cap that is assembled to a cylinder using a pressing operation.

The invention comprises, in one form thereof, a fluid activated cylinder assembly including an end cap having an annular protrusion and a hollow cylinder having an end zone. The cylinder applies compressive force to the annular protrusion in the end zone. The end zone having no accommodating cavity and no accommodating protrusion for the annular protrusion.

An advantage of the present invention is that the assembly of an end cap to a cylinder can be completed by a single pressing operation.

Another advantage of the present invention is that the cylinder does not require a machining operation to accommodate a protrusion from the end cap.

Another advantage is that the assembly can be assembled with very little time expenditure.

An even yet further advantage is the assembly of the present invention is a simple cost effective design.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
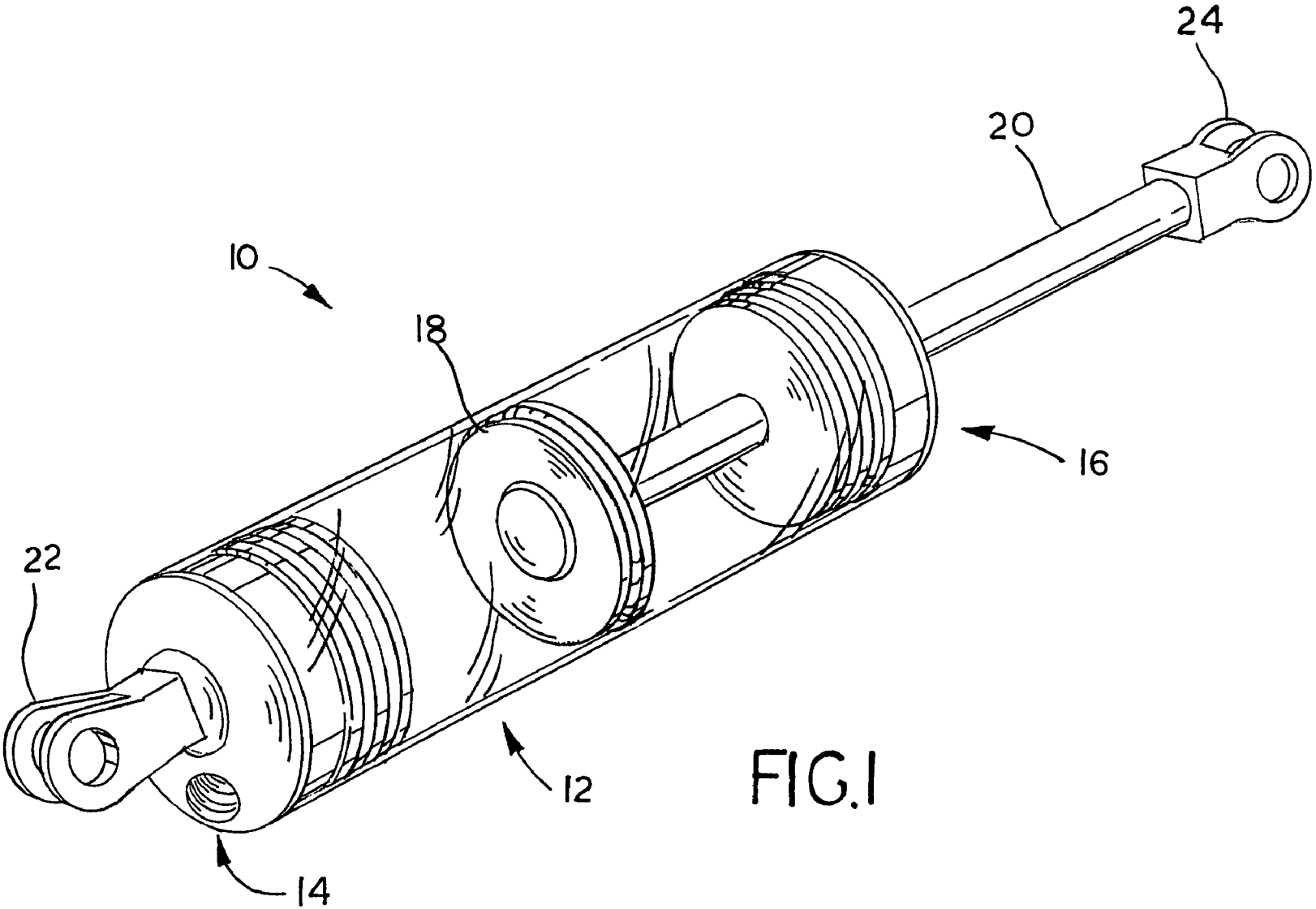
FIG. 1 is a perspective view of an embodiment of the cylinder assembly of the present invention.

Referring now to the drawings, and more particularly to FIG. 1, there is shown a cylinder assembly 10, which generally includes a cylinder 12, an end cap 14, an end cap 16, a piston 18, a shaft 20, and linkages 22 and 24. End caps 14 and 16 are substantially similar except that end cap 16 has a hole through the middle, to accommodate shaft 20. Shaft 20 is connected to linkage 24 and piston 18. Piston 18 is slidably sealed within cylinder 12. End caps 14 and 16 provide for the containment of a fluid within cylinder assembly 10, which can be a gas or liquid that causes the displacement of piston 18. Inlets are provided in both end caps 14 and 16 to provide for the movement of fluid therethrough.

Figure 2:
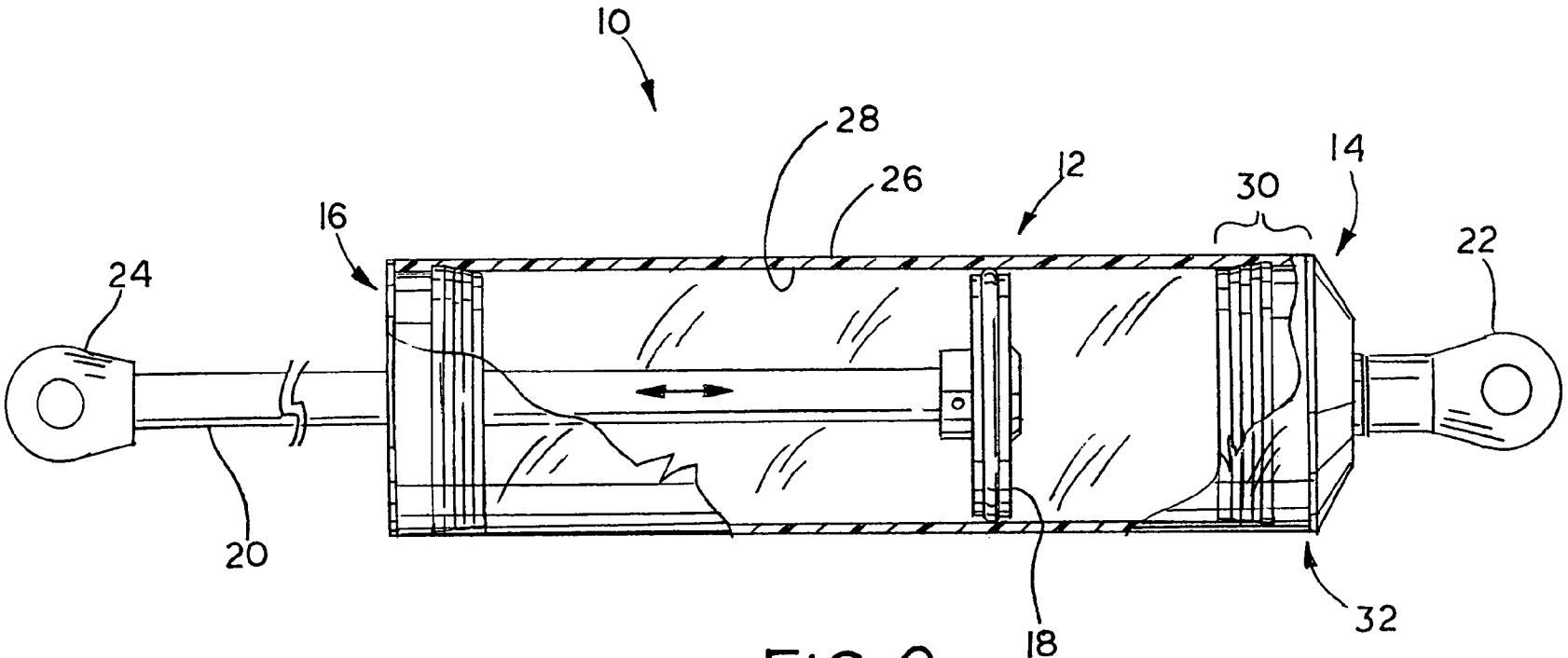
FIG. 2 is a partially section side view of the cylinder assembly of FIG. 1.

Now, additionally referring to FIG. 2, cylinder 12 includes an outer surface 26 and an inner surface 28. Cylinder 12 is substantially cylindrical having cylindrical inner and outer surfaces 26 and 28. Cylinder 12 may be made of a resin material that is impregnated into layered fibers. The fibers have a "wet out" characteristic, which soaks up resin better than normal fibers, making cylinder 12 substantially translucent. The high wetting characteristic of the fibers prevent voids in the cylinder, which would lead to a less translucent appearance. The fibers may be wound, thereby orienting the fibers in at least one layer. Additionally, an epoxy may be utilized to wet the fibers and form surfaces 26 and 28.

Cylinder 12 has no cavities, grooves, holes or protrusions in said end zone 30 for accommodating any feature on end caps 14 and 16. End cap 14 is pressed into an end of cylinder 12, and more particularly into an end zone 30 portion of cylinder 12. Distal end 32 of cylinder 12 is positioned in an area in which, upon the insertion of end cap 14, it can relax into a non-compressed mode. An end surface 34 of cylinder 12 interfaces with a boss of end cap 14.

Figure 3:
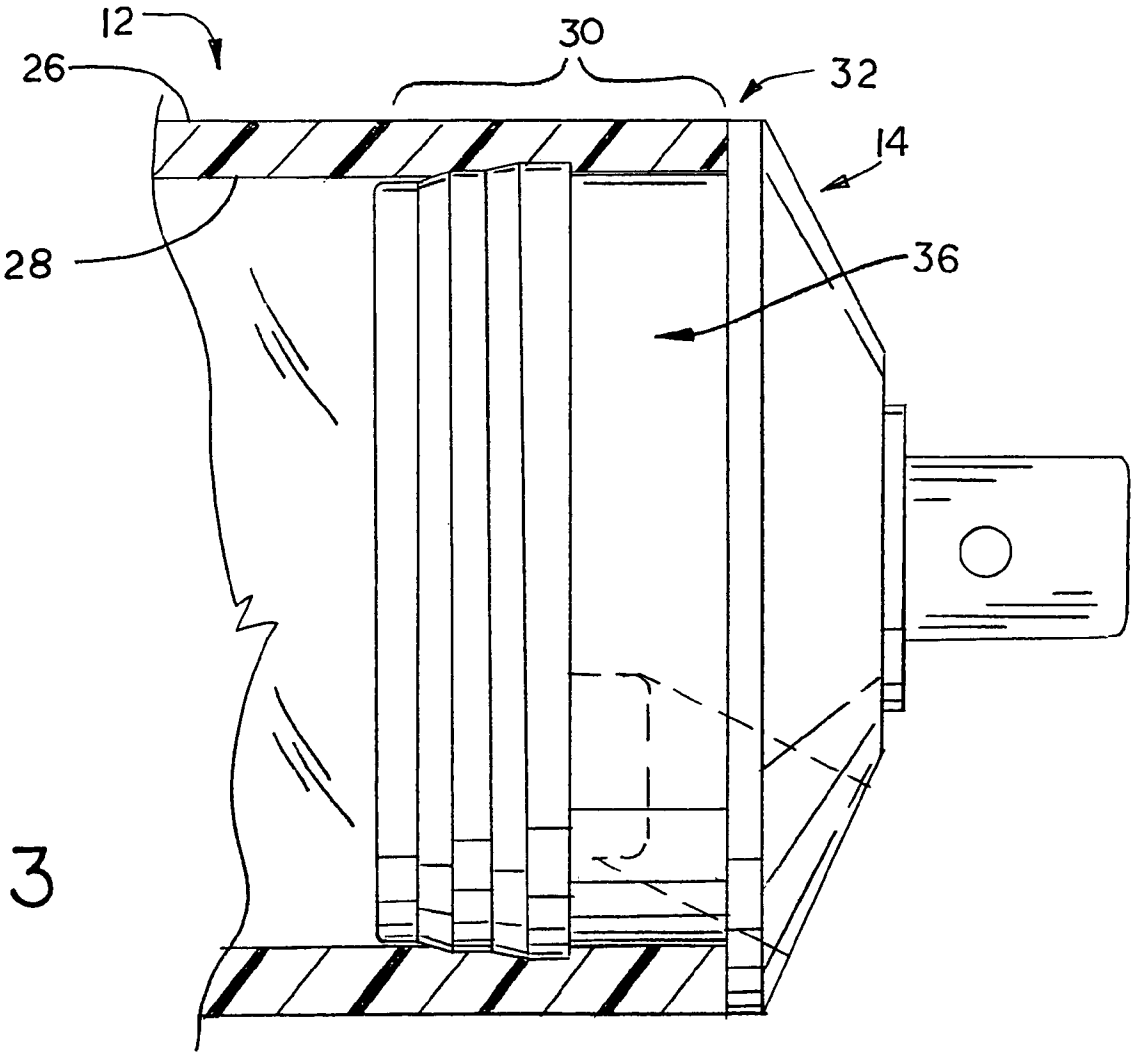
FIG. 3 is a partially sectioned enlargement of an end cap of the cylinder assembly of FIGS. 1 and 2.
Figure 4:
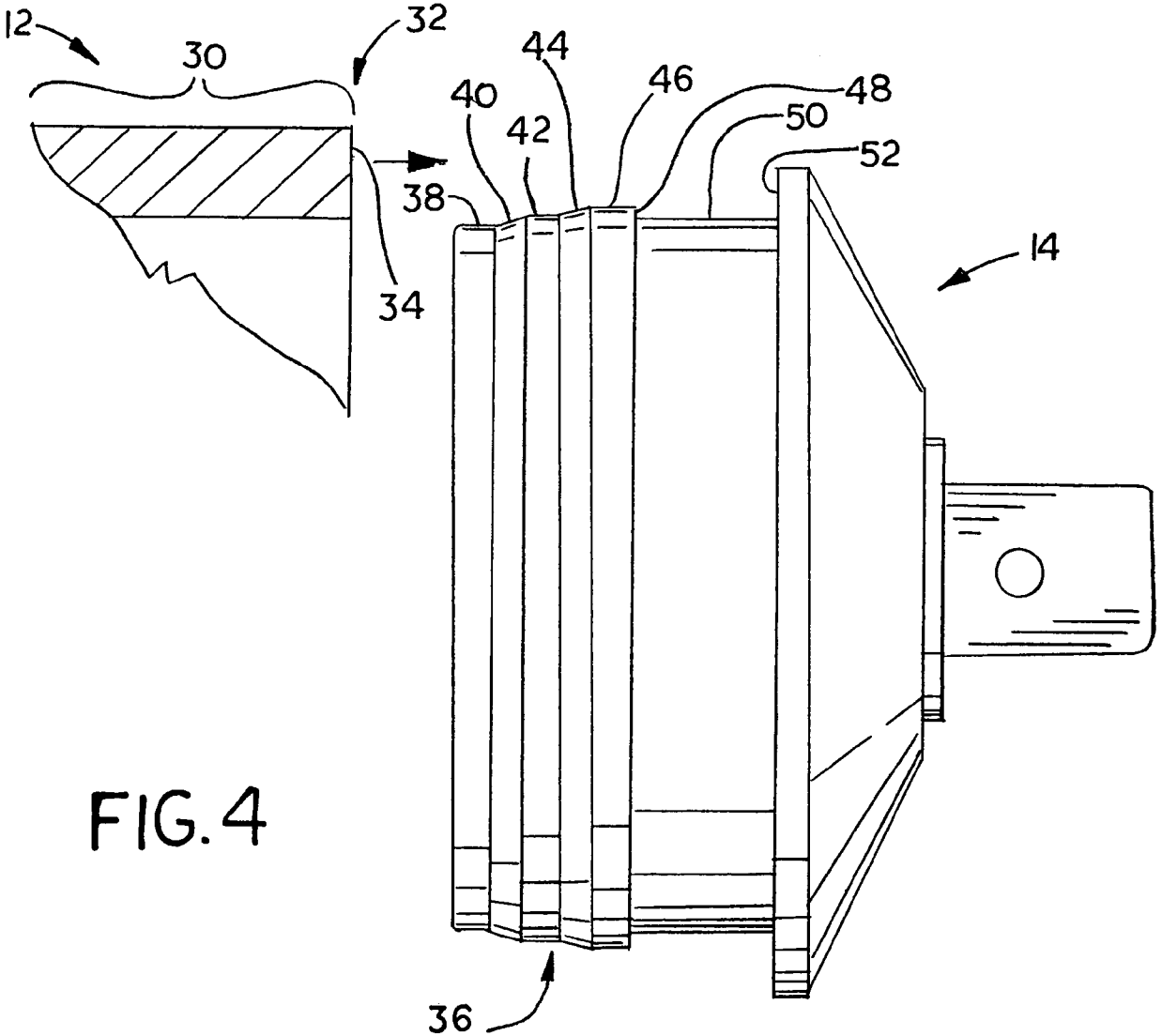
FIG. 4 is an exploded assembly view of an end cap and a portion of the cylinder of FIGS. 1–3.

Now, additionally referring to FIGS. 3 and 4, end cap 14 is illustrated, however, end cap 16 has substantially the same features as end cap 14. End cap 14 includes annular protrusion 36 that is of a larger diameter than the diameter of inner surface 28 of cylinder 12. The pressing of end cap 14 into cylinder 12 causes the material of cylinder 12 to be at least temporarily forced outward as end cap 14 is pressed into cylinder 12. A portion of cylinder 12 at distal end 32 relaxes around annular protrusion 36, thereby holding end cap 14 in position within cylinder 12. The insertion force of end cap 14, as it is slid into cylinder 12, is less than the force required to remove end cap 14 from cylinder 12. This property is arrived at by the shape of annular protrusion 36. Annular protrusion 36 may be partially curved or have ramped portions as illustrated in the figures.

End cap 14 has a lead-in portion 38 which may be slightly smaller in diameter than the interior diameter of surface 28. Additionally, lead-in surface 38 may have a radiused portion to aid in the insertion of end cap 14 into cylinder 12. Following lead-in portion 38 is first ramped portion 40. The surface of ramped portion 40 is an inclined surface when seen in a cross-sectional view. As distal end 32 of cylinder 12 encounters ramped portion 40, the resilient nature of cylinder 12 allows for the flexing outward of the wall of cylinder 12 as end cap 14 is pressed into end zone 30. Following first ramped portion 40 is first raised portion 42 which is substantially flat and parallel to surface 28. Following raised portion 42 is a second ramped portion 44 that places further outward force on cylinder 12. Following second ramped surface 44 is a second raised portion 46.

Following second raised portion 46 is an abrupt reduction portion 48, where the diameter of annular protrusion 36 is reduced to substantially the inner diameter of cylinder 12 in its relaxed stated. Following abrupt portion 48 is reduced diameter portion 50, which allows for a relaxed area of cylinder 12 to reposition itself as shown in FIG. 3. End cap 14 is inserted until end surface 34 contacts boss 52, thereby controlling the depth of insertion of end cap 14 into cylinder 12. The material of cylinder 12 places a compressive force on annular protrusion 36 and abrupt section 48 serves to substantially increase the force required to remove end cap 14 from cylinder 12. It is the resilient nature of cylinder 12 that coacts with the shape of annular protrusion 36 of end cap 14 to advantageously serve to secure end cap 14 in cylinder 12.

During the insertion of end cap 14 into cylinder 12, cylinder 12 is stressed, without severing the fibers therein. Preferably the stress to the wall of cylinder 12, at the point of insertion is about 65% to 70% of the ultimate burst strength of cylinder 12. The inherent elasticity of the material of cylinder 12 maintains a constant external radial pressure on end cap 14, with minimal long term creep that would allow relaxation of pressure therefrom. The constant external radial pressure is due to the non-creep characteristic of the fibers in cylinder 12. This pressure obviates the need to incorporate a seal, such as an O-ring, to prevent leakage from assembly 10.

It is the nature of abrupt section 48 to resist the removal of end cap 14 from cylinder 12, since it takes more force to expand the material of cylinder 12 over an abrupt edge than over an inclined ramp. Further, the hardness of the material of end cap 14 also alters the removal force, in that abrupt section 48 will serve to shear part of the inner filaments of cylinder 12, if an attempt is made to remove end cap 14 from cylinder 12.

Advantageously, cylinder 12 can be a hollow cylindrical resin and fiber construct that is cut to a required length and without further preparation of cylinder 12, end caps 14 and 16 may be inserted to produce cylinder assembly 10. As can be seen in FIG. 3, end cap 14 is positioned in cylinder 12, where, at distal end 32, inner surface 28 is relaxed to be a substantially similar diameter as that portion of cylinder 12 that is outside of end zone 30. The relaxed portion at distal end 32 is an important feature since the end of cylinder 12 is cut, thereby exposing fibers from the material of cylinder 12 and the cut fibers will have a tendency to potentially ravel and unwind over time if distal end 32 is not in a relaxed state.

Advantageously, compressive force applied by cylinder 12 against end cap 14 causes material of cylinder 12 to seal around annular protrusion 36, thereby sealing fluid contained within cylinder assembly 10.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fluid activated cylinder assembly, comprising:

an end cap having an annular protrusion; and a hollow cylinder having an end zone, said cylinder applying compressive force to said annular protrusion in said end zone, said end zone having no accommodating cavity and no accommodating protrusion for said annular protrusion, said annular protrusion having a first ramped surface and a second ramped surface, said ramped surfaces being separated by a region of substantially constant diameter and enlarging in diameter toward a distal end associated with said end zone, said annular protrusion additionally including an abrupt reduction in diameter, said abrupt reduction in diameter being closer to said distal end than the ramped surfaces are to said distal end.

2. The assembly of claim 1, wherein said end cap additionally includes a boss that abuts an end surface of said cylinder.

3. A fluid activated cylinder assembly, comprising:

an end cap having an annular protrusion; and a hollow, substantially translucent, cylinder having an end zone, said cylinder applying compressive force to said annular protrusion in said end zone, said end zone having no accommodating cavity and no accommodating protrusion for said annular protrusion, said cylinder is substantially cylindrical internally and externally having no grooves, no holes and no protrusions and made of a resin and wetted fibers compound.

4. A cylinder assembly comprising:

a cylinder having an interior of a first diameter, said cylinder having an end zone and a distal end, said cylinder having no grooves in said end zone of said interior; and an end cap having an annular protrusion of a second diameter, said annular protrusion at least partially in contact with said interior, said second diameter being larger than said first diameter, said annular protrusion additionally including an abrupt reduction in diameter, said abrupt reduction being closer to said distal end than said at least one ramped surface is to said distal end;

said annular protrusion including a first ramped surface and a second ramped surface, said ramped surfaces being separated by a region of substantially constant diameter and enlarge in diameter toward said distal end.

5. The assembly of claim 4, wherein said end cap additionally includes a boss that abuts an end surface of said cylinder.

6. The assembly of claim 4, wherein said cylinder is substantially cylindrical internally and externally having no grooves, no holes and no protrusions.

7. The assembly of claim 6, wherein said cylinder is made of a resin and wetted fibers compound.

8. The assembly of claim 7, wherein said cylinder is substantially translucent.

9. A method of assembling a cylinder device, comprising the steps of:

providing a hollow cylinder having an end zone and a distal end, said cylinder having no protrusions and no grooves in said end zone; and pressing an end cap into an end of a cylinder, said end cap having an annular protrusion that at least temporarily displaces a portion of said cylinder, said annular protrusion having a first ramped surface and a second ramped surface separated by a region of substantially constant diameter, said ramped surfaces enlarging in diameter toward said distal end, said annular protrusion additionally including an abrupt reduction in diameter, said abrupt reduction in diameter being closer to said distal end than said at least one ramped surface is to said distal end.

* * * * *